United States Patent [19]

McCartney

[11] Patent Number: 4,596,078

[45] Date of Patent: Jun. 24, 1986

[54] DRYING DEVICE

[76] Inventor: Lorne R. McCartney, 50 Jackson Court, Kanata, Ontario, Canada, K2K 1B7

[21] Appl. No.: 595,024

[22] Filed: Mar. 30, 1984

[30] Foreign Application Priority Data

May 19, 1983 [CA] Canada ..... 428544

[51] Int. Cl.[4] ..... F26B 9/00

[52] U.S. Cl. ..... 34/103; 34/104; 34/106; 34/239

[58] Field of Search ..... 34/21, 103, 104, 106, 34/239; 206/499, 509, 511, 512; 220/380

[56] References Cited

U.S. PATENT DOCUMENTS

| | | | |
|---|---|---|---|
| 377,603 | 2/1888 | Damm | 206/499 |
| 426,111 | 4/1890 | Coffin | 34/104 |
| 686,314 | 11/1901 | Mansfield | 34/104 |
| 1,074,888 | 10/1913 | McIver | 34/104 |
| 1,280,445 | 10/1918 | Grace | 34/104 |
| 1,326,519 | 12/1919 | McLaren | 206/499 |
| 1,529,413 | 3/1925 | Anderson | 206/509 |
| 1,543,800 | 6/1925 | Shewry | 206/509 |
| 1,814,252 | 7/1931 | Leary | 206/511 |
| 1,944,827 | 1/1934 | Osherman et al. | 206/511 |
| 1,994,664 | 3/1935 | Pfitzer | 206/511 |
| 2,084,854 | 6/1937 | McCarthy | 34/103 |
| 3,645,009 | 2/1972 | Ketchum | 34/104 |
| 4,085,519 | 4/1978 | Masika | 34/104 |
| 4,136,464 | 1/1979 | Hay | 34/104 |
| 4,209,913 | 7/1980 | Wallin et al. | 34/103 |

FOREIGN PATENT DOCUMENTS

| | | | |
|---|---|---|---|
| 2227907 | 12/1973 | Fed. Rep. of Germany | 34/104 |
| 55-860 | 5/1979 | Japan | 34/104 |

*Primary Examiner*—Albert J. Makay
*Assistant Examiner*—David W. Westphal
*Attorney, Agent, or Firm*—Rogers, Bereskin & Parr

[57] ABSTRACT

A drying device comprises a hollow body and a plurality of supports for articles to be dried. The body has an inlet for communication with a source of heated air, for example a floor mounted outlet of a domestic hot air heating system or a hair dryer. The supports, which can comprise hollow protrusions with openings for heated air, are arranged to support articles so that they get an adequate supply of heated air. For this purpose, the supports can be shaped like certain articles, such as gloves and boots.

13 Claims, 6 Drawing Figures

DRYING DEVICE

This invention relates to a drying device, and more particularly, but not exclusively, relates to a device for drying articles of clothing.

In the home, articles of clothing, such as gloves or boots are typically dried simply by laying out the articles in a suitable location. Whilst most houses provide a hot dry atmosphere, it frequently takes a long time to dry some articles of clothing, since there is an inadequate circulation of air around and through each article. Some types of clothing, such as gloves, could be dried in a domestic drying machine, but this is undesirable in the case of articles which are not completely clean.

According to the present invention, there is provided a drying device comprising a hollow body which has a plurality of apertures and an inlet suitable for communication with a source of heated air, and a plurality of supports for articles to be dried, which supports are mounted on the hollow body extending therefrom, whereby, in use, heated air supplied to the hollow body through said inlet passes through said apertures to dry any articles supported on the supports.

In a preferred form of the present invention, the drying device is adapted to be mounted on an outlet of a forced air heating or ventilating system. Conveniently, the drying device is mounted on an outlet located in a floor.

The drying device of the present invention should enable articles of clothing to be dried quickly and easily. It is expected to be particularly useful for articles such as boots, as the insides of a pair of boots can be difficult to dry. For this purpose, the drying device can be provided with extension pieces, which extend the full length of the boot. Consequently, it is ensured that a current of warm air flows along the length of the inside of the boot, to dry it thoroughly.

For a better understanding of the present invention, and to show more clearly how it may be carried into effect, reference will now be made to the accompanying drawings which illustrate preferred embodiments of the invention by way of example, and in which.

Figure 1:
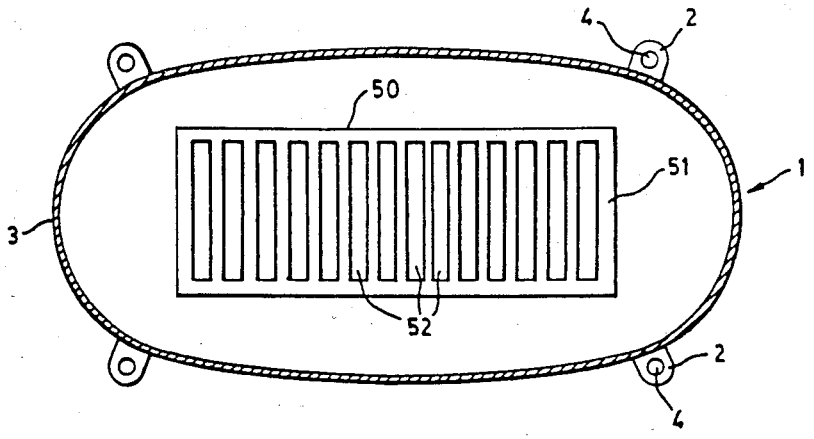
FIG. 1 shows a horizontal sectional view along the line 1—1 of FIG. 2, of a first embodiment of the drying device.
Figure 2:
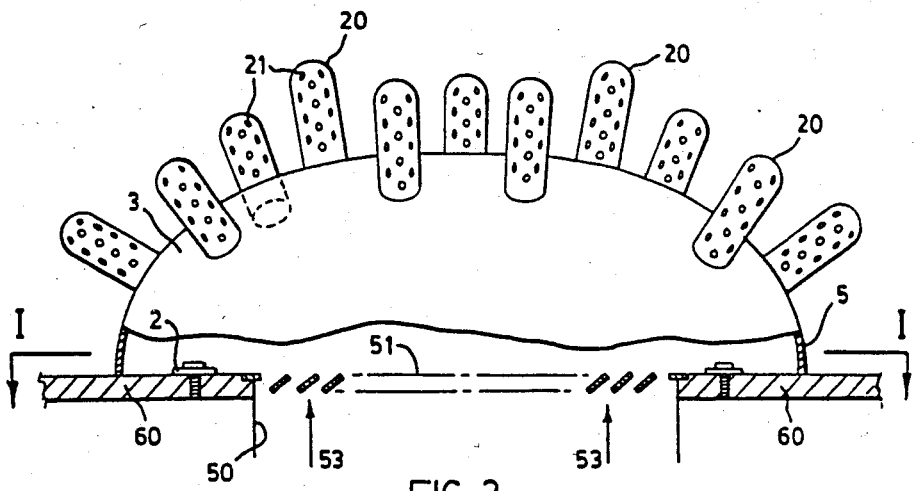
FIG. 2 shows a side view in partial section, of the drying device, shown in FIG. 1.

In FIG. 1, a drying device 1 is shown located on an outlet 50 of a forced air heating system, such as a forced air gas heating system. The outlet 50 is provided, in known manner, with a grille 51, which defines a plurality of elongate transverse rectangular slots 52. The drying device 1 has a main body 3, which is adapted to fit over the outlet 50. Along an outer lower edge of the body 3, there are four securing lugs 2 each of which has a hole 4. As shown in FIG. 2, when the drying device 1 is located on a floor 60 surrounding the outlet 50, screws 5 can be passed through the holes 4, to secure the drying device 1 in position.

With reference to FIG. 2, a number of protrusions 20 are provided extending from the main body 3 of the drying device 1. The protrusions 20 are hollow, and their interiors are continuous with the hollow interior of the main body 3. As shown, each protrusion 20 can be elongate with a circular cross-section and with a spherical end. Each protrusion 20 is provided with a plurality of openings 21. In use, articles of clothing can be located on the protrusions 20. Heated air is forced upwards and outwards through the outlet 50, as indicated by the arrows 53, into the hollow body 3. This heated air then flows along the protrusions 20 and out through the openings 21. Depending on the nature of the article of clothing, the heated air then either flows through the material of the article, or along its length to an opening in the article. In either case, the article of clothing is provided with a uniform constant flow of heated dry air, to ensure sufficient drying of the article.

It is to be appreciated that the drying device 1 could take many different forms. The main body 3 could be rectangular, square, oval or round. Also, it could advantageously be provided with a gasket of resilient material, for example, foam rubber, on its bottom face, in order to form a seal between the drying device 1, and the grill 51 or the portion of the floor 60 surrounding the grill 51. Further, the protrusions 20 could also have a wide variety of different shapes and sizes. The cross-section of each protrusion 20 could be square, oval, rectangular or hexagonal. This cross-section need not be constant along the length of the protrusion 20, but could vary.

The ends of the protrusions 20 need not be rounded, but could take a variety of forms. They could be flat or pointed. The size and distribution of the openings 21 along the length of each protrusion 20 can be varied in order to adapt each protrusion 20 for different articles of clothing. For example, in the case of socks, the openings 21 could be provided uniformly among the length of a protrusion 20, since the heated air will flow out through the material of the sock. Such an arrangement should ensure a uniform flow of heated air throughout all the material of the sock. On the other hand, for a non-porous article, for example a leather article, it may be desirable simply to provide one relatively large opening 21 at the free end of a protrusion 21. When such a leather article is placed on that protrusion 21, a uniform flow of heated air should flow down through the inside of the article in the generally annular space between the protrusion 21 and the articles to an open end of the article adjacent the main body 3.

Figure 3:
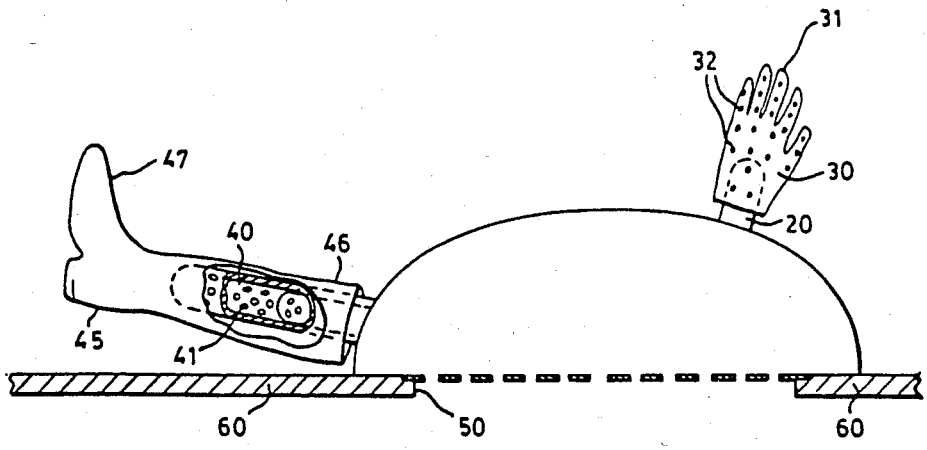
FIG. 3 is a side view of the drying device of FIGS. 1 and 2, showing further features of the invention.

FIG. 3 shows two possible variants of the first embodiment of the drying device 1. For clarity, in FIG. 3, all the protrusions 20 are not shown. On the right hand side of FIG. 3, there is shown a first extension piece 30. The extension piece 30 is generally hollow, and is adapted to be fitted onto a protrusion 20 so that each opening 21 (not shown in FIG. 3) of that protrusion 20 is either closed or opens into the interior of the extension piece 30. The extension piece 30 is shaped to fit a glove, and includes finger and thumb extensions 31. Openings 32 are provided all over the extension piece 30, including the finger and thumb extensions 31. In use, with the extension piece 30 located on a protrusion 20 as shown, a glove can be fitted onto the extension piece 30, with the finger and thumb extensions 31 located in the finger and thumb portions of the glove. The openings 32 then ensure an adequate supply of warm dry air to all parts of the glove. If necessary, for a non-porous glove, relatively large openings could be provided at the free ends of the finger and thumb extensions 31, with only a few, or no other openings 32 along the length of the finger and thumb extensions 31. This should ensure that the inside of the glove is dried by currents of air flowing down the length of each finger and thumb portion of the glove and then through the opening of the glove.

As shown on the left hand side of FIG. 3, an extension piece 40 could be provided for boots. Like the extension piece 30, the extension piece 40 is adapted to fit a protrusion 20, so that the openings 21 are either closed or open into a hollow interior of the extension piece 40. The extension piece 40 is provided with openings 41. In use, a boot 45 is located on the extension piece 40, as shown. Heated air then flows out through the openings 41 and into the interior of the boot 45. Assuming the boot is non-porous, heated air will then flow along the inside of the boot in the annular space between the boot 45 and the extension piece 40, until it vents to atmosphere at the neck 46 of the boot 45. Again, a major opening 41, or the only opening 41, can be provided at the extreme end of the extension piece 40, in order to ensure a uniform flow of air along the whole length of the boot 45. This should also assist in ventilation of the foot portion 47 of the boot 45. In order to assist in ventilation of the foot portion 47, the extension piece 40 can be provided with an upwardly extending portion (not shown) for the foot portion 47.

Figure 4:
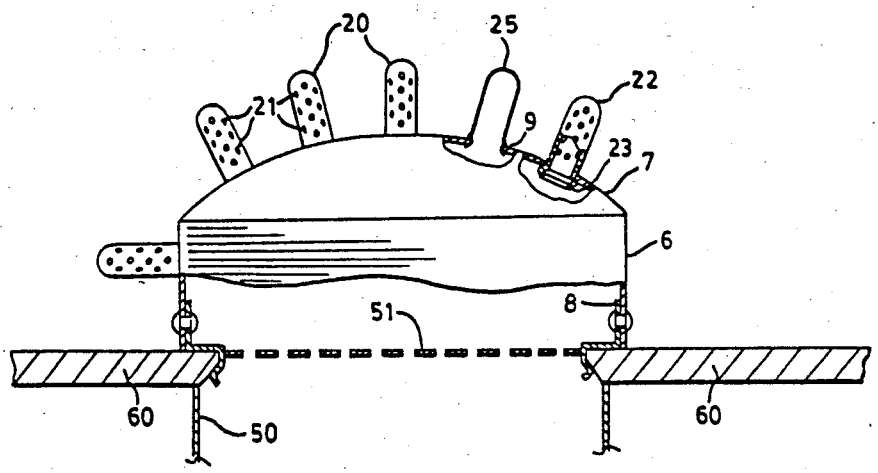
FIG. 4 is a side view of a second embodiment of the drying device.

FIG. 4 shows a second embodiment of the present invention. In this embodiment, the main body 3 is provided with flat ends 6, which give the main body 3 a rectangular cross-section corresponding to the rectangular shape of the grill 51. A generally curved upper part 7 of the body 3 is continuous with the ends 6. Protrusions 20 extend from the curved upper surface 7 and the ends 6. As before, the protrusions 20 are provided with openings 21. In this embodiment, instead of the securing lugs 2, two opposite ends 6 are provided with clips 8, which are secured to or integral with their respective ends 6. The clips 8 enable the drying device to be secured releasably to the grill 51 of an outlet 50. Similarly, a protrusion 22 is shown provided with similar clip means 23 around its lower edge, to enable it to be clipped into an aperture 9 in the upper surface 7. By this means, the drying device can be provided with interchangeable protrusions 22 so that a protrusion 22 of the appropriate shape can be selected for each article of clothing to be dried.

FIG. 4 also shows a further variant of the protrusions. Here, a support 25 is provided which is formed from a loop of wire of similar profile to the protrusions 20. The two lower ends of the side limbs of the wire are shaped to engage the periphery of an aperture 9. This secures the support 25 in position. Now, an article of clothing can be mounted on the support 25 so that it is open and ready to receive heated air flowing out through the aperture 9. This ensures a uniform air supply to the interior of the article in a simple manner, and consequently uniform drying of the article.

The support 25 is shown formed from a single loop of wire. It is to be appreciated that the support 25 would be formed from two or more pieces of wire in a variety of configurations. For example, the support 25 could be formed from a single piece of wire whose central portion forms a helix. Alternatively, such a helical construction could be combined with the loop construction shown in FIG. 4.

Although as, shown, a wide variety of shapes and sizes of protrusions can be used, generally each drying device will only be provided with one type of protrusion or support.

Figure 5:
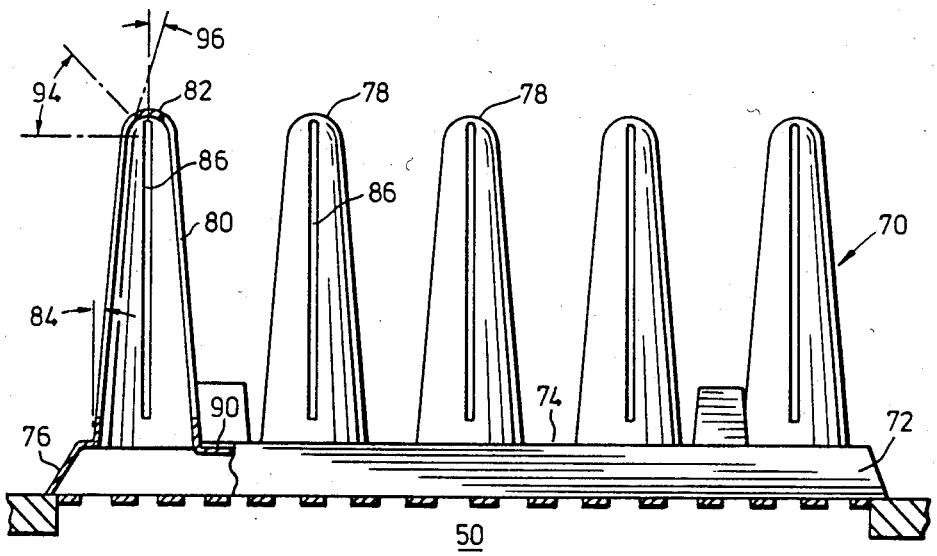
FIG. 5 is a side view, in partial section, of a third embodiment of a drying device.
Figure 6:
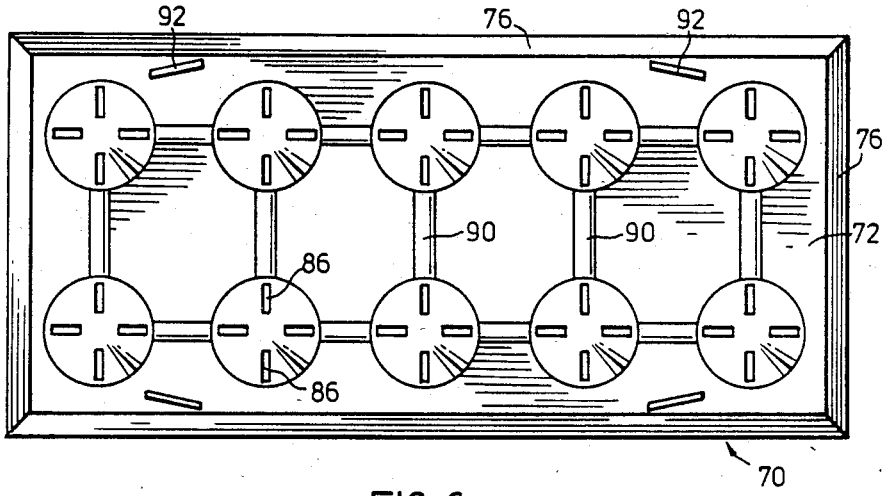
FIG. 6 is a plan view of the drying device of FIG. 5.

FIGS. 5 and 6 show a third, preferred embodiment of the drying device. Here, the device is generally indicated by the reference 70. It is formed as a 1-piece moulding in a plastic material.

The drying device 70 comprises a base 72, which as indicated in the partial section on the left-hand side of FIG. 5, is of uniform thickness. The base 72 comprises a flat top surface 74, and sloping edge surfaces 76.

Extending upwards from the base 72 are 10 protrusions 78. Again, as shown in the partial section on the left-hand side of FIG. 5, each protrusion 78 has a uniform wall thickness, which corresponds to the wall thickness of the base 72. Each protrusion 78 has a generally conical portion 80 and a spherical top portion 82, as indicated for the left-hand protrusion in FIG. 5. The angle of the sides of the portion 80, indicated at 84, is 5°.

Each of the protrusions 78 is provided with four slots 86 arranged symmetrically. Each slot 86 is of uniform width, and extends from near the base 72 nearly to the top of the respective protrusion 78. The slots 86 can have a width of $\frac{1}{8}$". In FIG. 6, for simplicity, the slots 86 are shown only for one of the protrusions 78. As shown here, the conical portion 80 of the protrusions 78 is effectively divided into four quarters, which are connected together at the top of the protrusion 78.

Extending between these protrusions 78 is a network of channels 90, which can be $\frac{1}{4}$" wide and $\frac{1}{8}$" deep. In FIG. 5, one of these channels 90 is shown in the partial section. Extending from the base 72, there are additionally provided four projections 92. The purpose of these projections 92 is to enable a number of the drying devices to be stacked, with the protrusions 78 inside one another. The projections 92 prevent the protrusions 78 becoming jammed or wedged inside one another. It is to be appreciated that these projections 92 are optional and serve to assist in stacking. If desired, they can be omitted.

In use, like the other embodiments, the drying device 70 is mounted on an air outlet 50, shown in FIG. 5. Warm air is distributed through the base 72 to the protrusions 78. From the interior of the protrusion 78, the air flows out through the slots 86. The protrusions 78 have dimensions which should suit a number of different articles, such as boots or mittens. As described above, such boots or mittens placed on the protrusions 78 will be dryed by a current of warm air flowing through them. The channels 90 serve to ensure that air flowing into an article can escape from the article. Additionally, the channels 90 help to collect water dropping from the articles and prevent it getting onto the floor.

The protrusions 78 could have a height in the range $4\frac{1}{2}$ to 5". The two rows of protrusions 78, as viewed in FIG. 6, could be spaced by $2\frac{3}{4}$", and the protrusions 78 in each row could be spaced by $2\frac{1}{4}$". However, it is to be appreciated that other dimensions and spacings can be used, particularly if a drying device is intended for a particular application. An angle 94 at the top of each slot 86 is 45° whilst an angle 96 of a surface at the end of each slot 86 is 15°.

Although the device in FIGS. 5 and 6 is shown without any securing lugs, securing lugs 2, as shown in FIG. 1, or clips 8, shown in FIG. 4, could be provided. The lugs or clips would be formed integrally with the base 72 of the drying device 70.

Whilst the drying device 70 is shown adapted for mounting on an air outlet 50, a similar drying device could be provided for attachment to a hair dryer, or similar source of hot air. In this case, the base would be formed, so as to provide a suitable inlet, for connection to the hair dryer or other warm air source.

In order to ensure adequate supply of air to each article of clothing located on the drying device, the main body of the drying device can be provided with a plurality of apertures each of which is provided with a flap or other closure means normally biased into a close position. The protrusions will be separate from the main body, and each protrusion can be fitted and retained in an aperture. Once a protrusion is fitted to an aperture, the flap or other closure means is opened, to permit flow of air into that protrusion. Thus, heated air can only flow out from the main body through those apertures to which protrusions have been fitted, and then out through the protrusions. In use, the drying device will be fitted with appropriate protrusions for the articles of clothing to be dried. This ensures that there are no unused protrusions, through which an excessive amount of air could flow, depriving other protrusions and their associated articles of clothing of an adequate supply of heated air. It is to be appreciated that this type of construction could also be provided in an drying device which includes a small number of fixed protrusions.

The drying device can be made from a variety of materials, such as plastics, fiberglass, and metal. It can be made in any colour or any combination of colours, and, in order to make it appealing to children, it can be shaped like an animal such as a turtle or porcupine. The protrusions could be, for example 2–5" in length. Instead of screws or nails, the drying device could be adapted to be secured by magnets or tape, or could be free-standing.

Whilst the described embodiments of the drying device have been directed to a drying device for use on an outlet of a forced air heating system, it is also anticipated that the drying device could be advantageously used with a hair dryer or other similar source of hot air. In this case, the drying device will be provided with a suitable inlet for connection to the hair dryer, or the like, and it could also be provided with means to ensure that it stands in a desired position.

I claim:

1. A drying device which is formed as a unitary moulding in a plastic material, the drying device comprising: a hollow body which is open along a bottom thereof and is of generally rectangular shape so as to be adapted for mounting on a rectangular floor register to receive hot air therefrom and which body includes a flat top surface in which a plurality of channels are formed; and a plurality of supports integral with the main body of the drying device, each support extending vertically from the body and being formed as a hollow protrusion and comprising a major portion, which tapers upwardly and which has a cross-section that is congruous along the length of the major portion, and a plurality of elongate slots each of which extends vertically along the length of the support so as to form an elongate outwardly-directed slot-shaped nozzle, the channels extending away from the lower ends of the supports, to assist in draining and venting articles on the supports, wherein the main body and the supports including the slots are so shaped as to permit moulding of the device in a two-part mould.

2. A drying device as claimed in claim 1, wherein the major portion of each support is generally conical and has a circular cross-section.

3. A drying device as claimed in claim 2, wherein each support includes a rounded tip at its upper end.

4. A drying device as claimed in claim 3, wherein the slots are of equal length and all extend part way into the rounded tip.

5. A drying device as claimed in claims 1, 2 or 4, wherein each support includes four generally similar slots, which are spaced equally around each support.

6. A drying device as claimed in claims 1, 2 or 4, wherein the supports are arranged on a rectangular grid.

7. A drying device as claimed in claims 1, 2 or 4, which includes ten supports arranged in two rows of five supports, with adjacent supports being equally spaced.

8. A drying device as claimed in claims 1, 2 or 4, wherein the hollow body includes a flat top surface and a plurality of projections extending upwardly therefrom, to enable a number of drying devices to be stacked with the supports inside one another.

9. A drying device which is formed as a unitary moulding in a plastic material, the drying device comprising: a hollow body, which is open along a bottom thereof and is of generally rectangular shape with a flat top surface and inclined planar side surfaces, so as to be adapted for mounting on a rectangular floor register to receive hot air therefrom; a plurality of supports of equal height and integral with the main body of the drying device, each support extending vertically from the top surface of the hollow body being formed as a hollow protrusion and comprising a major portion, which is conical and tapers upwardly and which has a circular cross-section, a plurality of elongate slots each of which extends along the length of that support so as to form an elongate outwardly-directed slot-shaped nozzle, and a rounded tip; a plurality of channels formed in the flat top surface, extending away from the supports, to assist in draining and venting articles placed on the supports; and a plurality of projections of equal height extending from the top surface of the hollow body, to enable a number of drying devices to be stacked with the supports inside one another.

10. A drying device as claimed in claim 9, wherein each channel extends between a pair of adjacent supports.

11. A drying device as claimed in claim 9 or 10, wherein each support includes four equally spaced slots.

12. A drying device as claimed in claim 9 or 10, wherein the slots of each support extend into the round top thereof.

13. A drying device as claimed in claim 9, wherein the supports are located on a rectangular grid.

* * * * *